US008491333B2

(12) United States Patent
Evans

(10) Patent No.: US 8,491,333 B2
(45) Date of Patent: Jul. 23, 2013

(54) ROTARY LOCKING PUSH-ON CONNECTOR AND METHOD THEREOF

(75) Inventor: Wayne Evans, West Henrietta, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 13/173,715

(22) Filed: Sep. 9, 2011

(65) Prior Publication Data

US 2013/0065418 A1 Mar. 14, 2013

(51) Int. Cl.
*H01R 9/05* (2006.01)

(52) U.S. Cl.
USPC ..... 439/578; 439/345

(58) Field of Classification Search
USPC ..... 439/350, 352, 353, 578, 583–585, 439/345
See application file for complete search history.

(56) References Cited

U.S. PATENT DOCUMENTS

| | | | | |
|---|---|---|---|---|
| 5,316,494 | A * | 5/1994 | Flanagan et al. | 439/352 |
| 5,393,244 | A * | 2/1995 | Szegda | 439/394 |
| 6,093,043 | A * | 7/2000 | Gray et al. | 439/352 |
| 6,695,636 | B2 * | 2/2004 | Hall et al. | 439/352 |
| 7,075,338 | B2 * | 7/2006 | Mizuno et al. | 327/66 |
| 7,553,185 | B1 * | 6/2009 | Qu et al. | 439/578 |
| 7,669,316 | B2 * | 3/2010 | Johnsen | 29/828 |
| 7,727,013 | B1 * | 6/2010 | Paynter | 439/578 |
| 8,021,181 | B2 * | 9/2011 | Montena et al. | 439/352 |
| 8,177,582 | B2 * | 5/2012 | Amidon | 439/578 |

* cited by examiner

*Primary Examiner* — Thanh Tam Le
(74) *Attorney, Agent, or Firm* — Schmeiser, Olsen & Watts LLP

(57) ABSTRACT

A coaxial cable connector for mating with an interface port having external threads, comprising a post configured to receive a center conductor surrounded by a dielectric of a coaxial cable, the post including a plurality of engagement fingers, a connector body attached to the post, a sleeve member attached to the post and having a first end and ascend end, wherein the sleeve member includes one or more protrusions proximate the first end configured to contact the plurality of engagement fingers to secure the connector in a locked position. Furthermore, associated methods are also provided.

21 Claims, 12 Drawing Sheets

ROTARY LOCKING PUSH-ON CONNECTOR AND METHOD THEREOF

FIELD OF TECHNOLOGY

The following relates to connectors used in coaxial cable communication applications, and more specifically to embodiments of a locking push-on connector for securably locking the connector onto a corresponding port.

BACKGROUND

Connectors for coaxial cables are typically connected onto complementary interface ports to electrically integrate coaxial cables to various electronic devices. Push-on connectors are widely used by consumers for their ease of use, and apparent adequacy, but they rarely stay properly secured onto the port over time. Push-on connectors designed to lock the connector onto a port by sliding a sleeve member over fingers to grip the port can slip off the port over time or if the sleeve member is bumped or dislodged. Specifically, locking push-on connectors typically require only axial movement of the sleeve member to achieve a locked position. However, once in a locked position on the port, nothing ensures the connector will stay in the locked position. For example, the sleeve member need only be slightly pulled or slid back in an axial direction to abandon the locked position on the port. Accordingly, if the cable is tugged or the sleeve member is dislodged in a generally axial direction, the sleeve member can easily slide back and release the fingers gripping the port, thereby resulting in intermittent electrical contact leading to RF interference and/or leakage, or even worse, a complete disconnection of the connector from the port.

Thus, a need exists for an apparatus and method for preventing disengagement of a push-on connector from a port, or more specifically, an apparatus and method for securing a locked position of a coaxial cable connector onto a port.

SUMMARY

A first general aspect relates to a coaxial cable connector for mating with an interface port having external threads, comprising a post configured to receive a center conductor surrounded by a dielectric of a coaxial cable, the post including a plurality of engagement fingers, a connector body attached to the post, and a sleeve member attached to the post and having a first end and a second end, wherein the sleeve member includes one or more protrusions proximate the first end configured to contact the plurality of engagement fingers to secure the connector in a locked position.

A second general aspect relates to a coaxial cable connector for connecting to an interface port comprising a post having a first end and a second end, the post further including a post basket, wherein the post basket includes one or more engagement fingers, a connector body attached to the post, and a sleeve member slidably engaged to the post and having a first end and a second end, the sleeve member having one or more protrusions located proximate the first end of the sleeve member, wherein the sleeve member is slidable from a first position to a second position, wherein rotation of the sleeve member when the sleeve member is in the second position, positions the protrusions into contact with the plurality of engagement fingers to secure the connector in a locked position.

A third general aspect relates to a coaxial cable connector adapted to mate with a port, comprising a post configured to receive a center conductor surrounded by a dielectric of a coaxial cable, the post including a plurality of engagement fingers, a connector body attached to the post, and a means for securing the connector in a locked position with the port, wherein the means for securing the connector in the locked position includes rotation of a sleeve member.

A fourth general aspect relates to a method of securing a connector onto a port, comprising providing a post configured to receive a center conductor surrounded by a dielectric of a coaxial cable, the post including a plurality of engagement fingers, a connector body attached to the post, and a sleeve member slidably moveable along the post from a first position to a second position, wherein the sleeve member includes one or more protrusions proximate the first end, and rotating the sleeve member, when the sleeve member is in the second position, to position the protrusions into contact with the plurality of engagement fingers to secure the connector in a locked position.

A fifth general aspect relates to a jumper comprising a first connector, wherein the first connector includes a post configured to receive a center conductor surrounded by a dielectric of a coaxial cable, the post including a plurality of engagement fingers, a connector body attached to the post, and a sleeve member slidably moveable along the post from a first position to a second position, wherein the sleeve member includes one or more protrusions proximate the first end, and a second connector, wherein the first connector is operably affixed to a first end of the coaxial cable, and the second connector is operably affixed to a second end of the coaxial cable.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
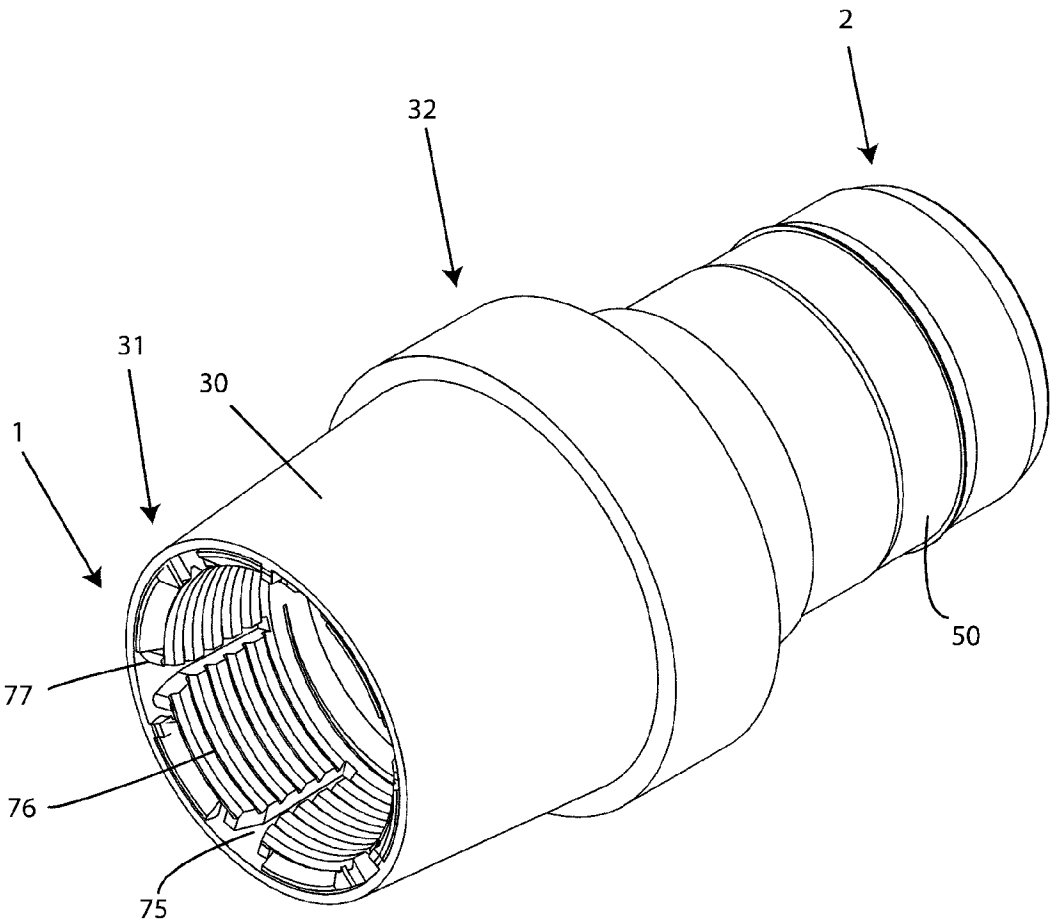
FIG. 1 depicts a perspective view of an embodiment of a coaxial cable connector.
Figure 9:
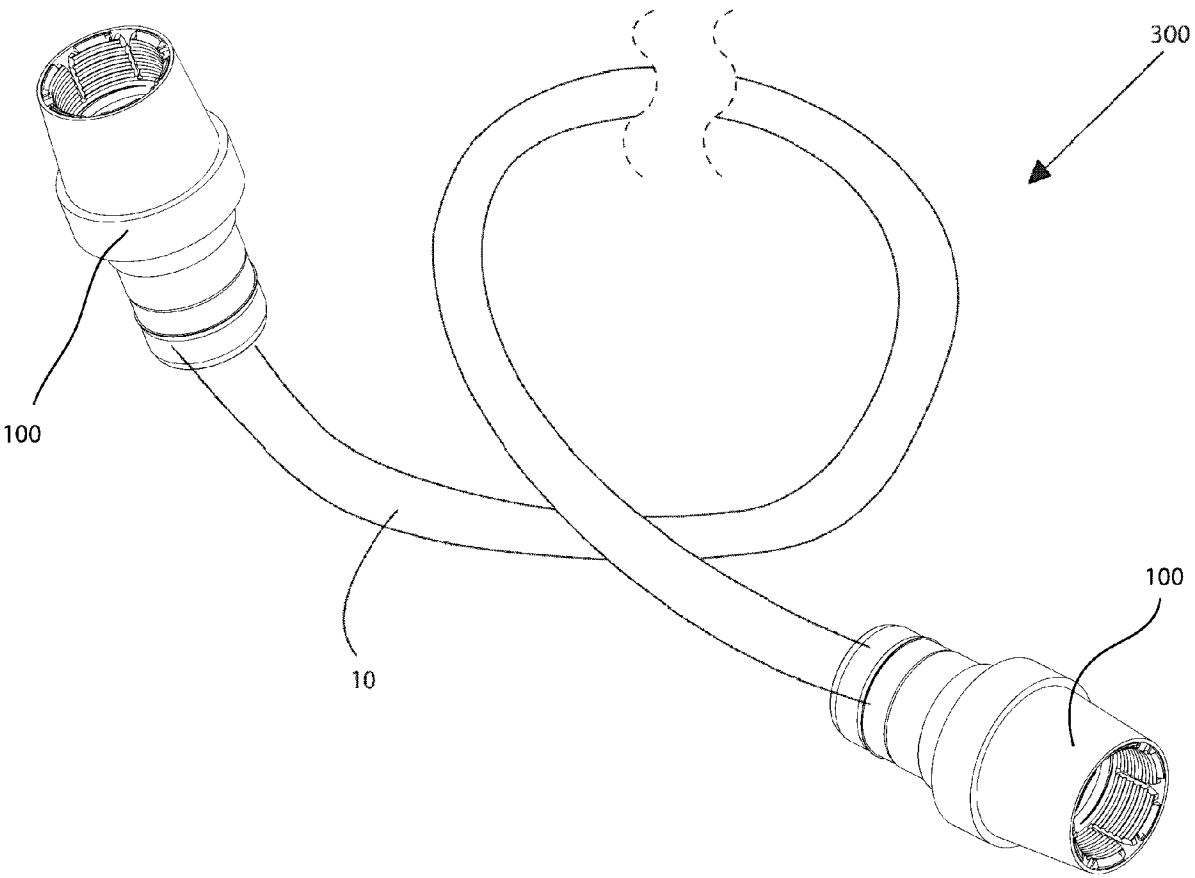
FIG. 9 depicts a perspective view of an embodiment of a jumper.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be a push-on connector, push-on F connector, or similar coaxial cable connector that requires only an axial force to mate with a corresponding port 20 (e.g. does not require lining up threads and rotating a sleeve member). Two connectors, such as connector 100 may be utilized to create a jumper 300 that may be packaged and sold to a consumer, as shown in FIG. 9. Jumper 300 may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper 300 includes both an uncompressed/open position and a compressed/closed position of the connector while affixed to the cable. For example, embodiments of jumper 300 may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper 300 may include other components, such as one or more signal boosters, molded repeaters, and the like.

Figure 2:
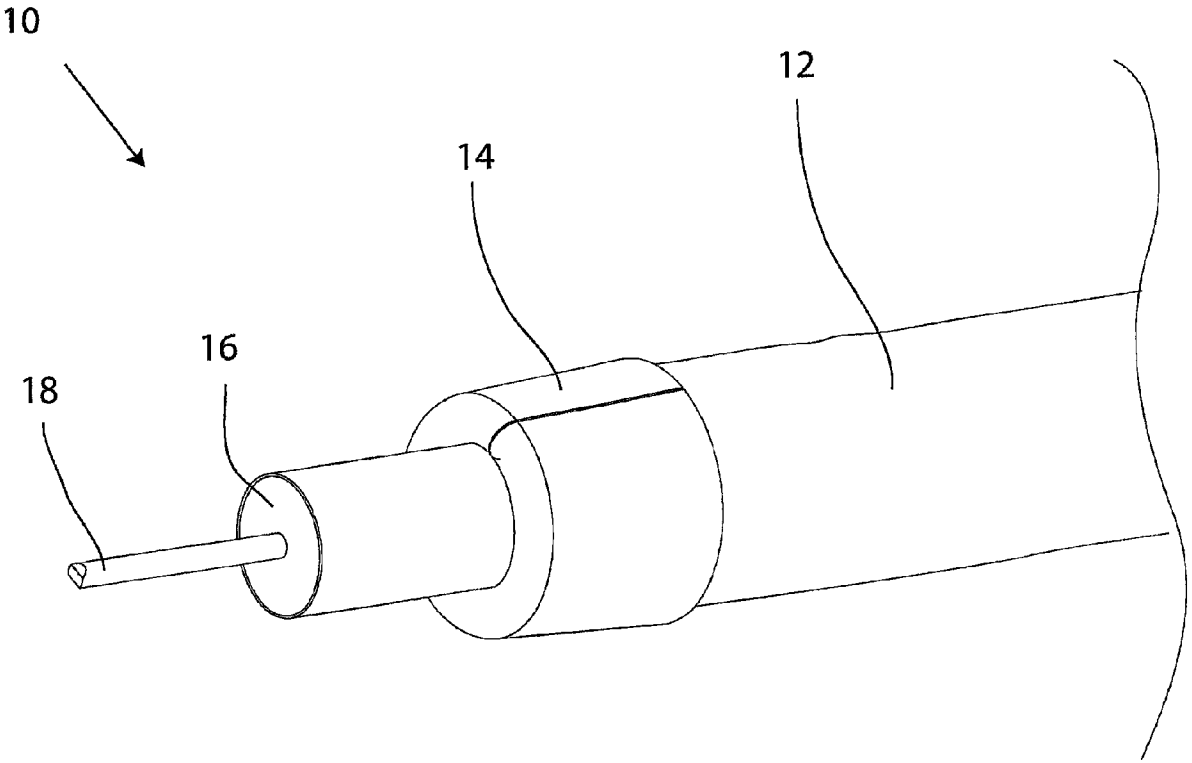
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12, wherein the protective outer jacket 12 has dielectric properties and serves as an insulator. The conductive strand layer 14, which is in electrical contact with the post 40, may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Figure 3:
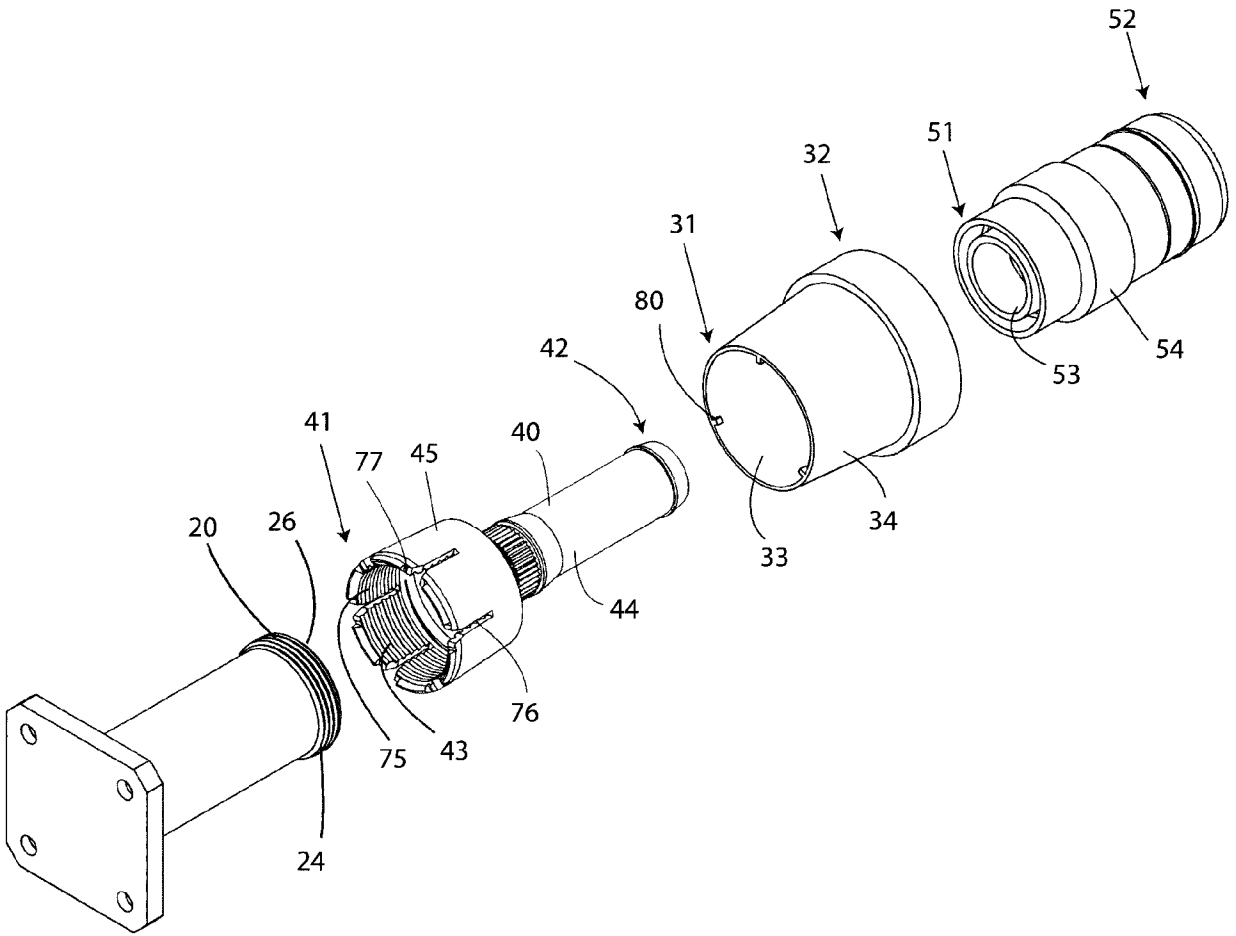
FIG. 3 depicts an exploded view of an embodiment of the connector.

Referring back to FIG. 1, and now with additional reference to FIG. 3, the connector 100 may mate with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 24. However, various embodiments may employ a smooth surface, or partially smooth surface, as opposed to a completely threaded exterior surface. In addition, the coaxial cable interface port 20 may comprise a mating edge 26. It should be recognized that the radial thickness and/or the length of the coaxial cable interface port 20 and/or the conductive receptacle may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. The threads 24 may also include a working surface 27, which may be defined by the pitch and depth requirements of the port 20. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle should be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIGS. 1 and 3, embodiments of a connector 100 may include a post 40 having a plurality of engagement fingers 75, a sleeve member 30 having one or more protrusions 80, a connector body 50, a fastener member 60. Embodiments of connector 100 may also include a post 40 configured to receive a center conductor 18 surrounded by a dielectric 16 of a coaxial cable 10, the post including a plurality of engagement fingers 75, a connector body 50 attached to the post 40, and a sleeve member 30 attached to the post 40 and having a first end 31 and a second end 32, wherein the sleeve member 30 includes one or more protrusions 80 proximate the first end 31 configured to contact the plurality of engagement fingers 75 to secure the connector in a locked position. Further embodiments of connector 100 may include a post 40 having a first end 41 and a second end 42, the post 40 further including a post basket 45, wherein the post basket 45 includes one or more engagement fingers 75, a connector body 50 attached to the post 40, and a sleeve member 30 slidably engaged to the post 40 and having a first end 31 and a second end 32, the sleeve member 30 having one or more protrusions 80 located proximate the first end 31 of the sleeve member 30, wherein the sleeve member 30 is slidable from a first position to a second position, wherein rotation of the sleeve member 30 when the sleeve member 30 is in the second position, positions the protrusions 80 into contact with the plurality of engagement fingers 75 to secure the connector in a locked position. Additional embodiments of connector 100 may include a post 40 configured to receive a center conductor 18 surrounded by a dielectric 16 of a coaxial cable 10, the post 40 including a plurality of engagement fingers 75, a connector body 50 attached to the post 40, and a means for securing the connector in a locked position with the port 20, wherein the means for securing the connector 100 in the locked position includes rotation of a sleeve member 30.

Figure 4:
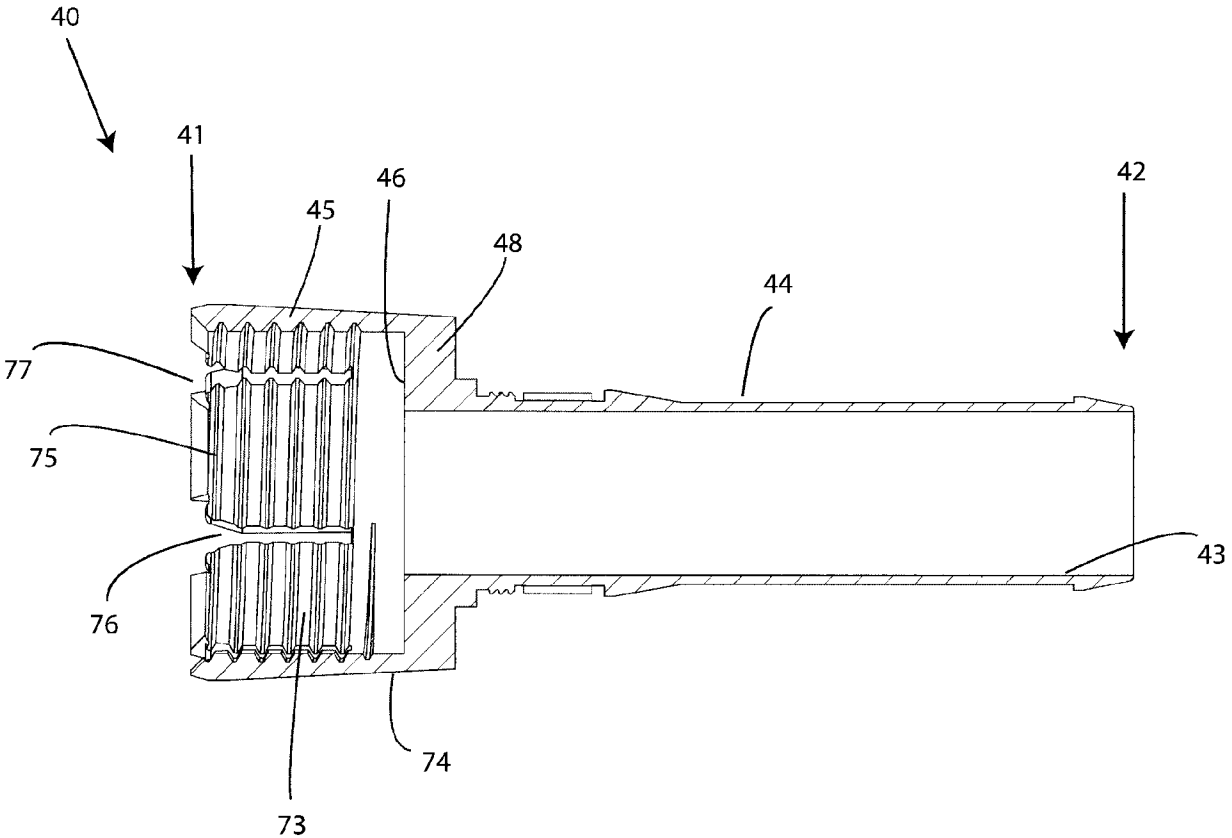
FIG. 4 depicts a cross-sectional view of an embodiment of a post.

Continuing to refer to FIGS. 1 and 3, and additionally referring to FIG. 4, embodiments of connector 100 may include a post 40. The post 40 comprises a first end 41, a second end 42, an inner surface 43, and an outer surface 44. Furthermore, the post 40 may include a post basket 45 proximate or otherwise near the first end 41. Embodiments of the post basket 45 may be structurally integral with a flange 48, such as an externally extending annular protrusion. Accordingly, the post 40 may be a one-piece component. The outer surface 44 of the post basket 45 may be a tapered surface such that the diameter and circumference of the post basket 45 may gradually increase from the flange 48 to the first end 41. In other words, embodiments of the post basket 45 may have a first diameter proximate the flange 48 and a second diameter proximate or otherwise near the first end 41 of the post 40, wherein the first diameter is smaller than the second diameter to facilitate a gradual compression of the post basket 45 onto the port 20. The inner surface 44 of the post 40 may be generally smooth; however, the inner surface 44 of the post basket 45 (or the inner surface of the engagement fingers 75) may be ribbed to allow the post basket 45 (engagement fingers 75) to pass over the external threads 24 of the port 20, while increasing the contact between the fingers 75 and the threaded port 20.

Moreover, post 40 may include a plurality of engagement fingers 75. For instance, the post basket 45 may include a plurality of openings 76 running axially from the first end 41 of the post 40 towards the flange 48 of the post 40. The portions of the post basket 45 that are separated by the openings 76 may be referred to as engagement fingers 75. Alternatively, the engagement fingers 75 may be a separate structural component that is press-fit between the flange 48 of the post and the sleeve member 30. The post basket 45 may include one or more openings 76 that axially extend a distance from the first end 41 to allow the post basket 45 (i.e. the engagement fingers 75) to flex radially inward when subjected to a compressive force from the sleeve member 30, and return to its original configuration when not subjected to a compressive force; the post basket 45 may be resilient. The openings 76 may be openings, slots, apertures, keyways, cavities, and the like that can be sized and dimensioned to allow a protrusion 80 located on the inner surface 33 of the sleeve member 30 to pass axially through. For example, the openings 76 may have a consistent width from the first end 41 to the end of the opening 76 proximate the flange 48, wherein the width is large enough to accommodate, or not significantly restrict the movement of the protrusion 80 from a first position to a second position when the sleeve member 30 is actuated. Alternatively, the openings 76 may be tapered from the first end 41 to the end of the opening 76 proximate the flange 48, wherein the tapered opening allows the protrusion 80 to freely move in an axial direction towards the first end 1 of connector 100. Most embodiments of the openings 76 of the post basket 45 can prevent axial movement of the protrusions 80 (and the sleeve member 30) when the protrusions 80 contact the end of the openings 76 proximate the flange 48. Accordingly, the post basket 45 may be slotted or otherwise separated into a plurality of engagement fingers 75 to provide resiliency when compressed to lock onto a port 20 and uncompressed to remove the connector 100 from the port 20.

Furthermore, embodiments of the engagement fingers 75 may include a notched surface 77 to accommodate, accept, support, etc., the protrusion 80 when in the fully secured position. The notched surface 77 may be one or more adjacent surfaces of the engagement finger 75 that can accept and support a protrusion 80 of the sleeve member 30. Additionally, the notched surface(s) 77 may be a notch, indentation, recession, extrusion, and the like in the engagement finger 75 that can accommodate the protrusion 80 and provide a normal force against the protrusion 80 preventing the axial movement of the sleeve member 30 in a direction toward the second end 2 of the connector 100 (e.g. away from the post 20). Each of the engagement fingers 75 may include one or more notched surfaces 77 proximate the openings 76 to accommodate a protrusion 80 regardless of the direction of rotation of the sleeve member 30 (i.e. clockwise or counter-clockwise). Thus after a user axially slides the sleeve member 30 along the post 40 towards the first end 1 of the connector 100 to compress/lock the fingers 75 onto the port 20, the user can rotate the sleeve member 30 in a clockwise or counter-clockwise direction to secure the connector into the locked position, as further described infra.

Further still, an embodiment of the post 40 may include a surface feature such as a lip or protrusion that may engage a portion of a connector body 50 to secure axial movement of the post 40 relative to the connector body 50. However, the post may not include such a surface feature, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40, including the post basket 45 (and the engagement finger 75) can be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 5:
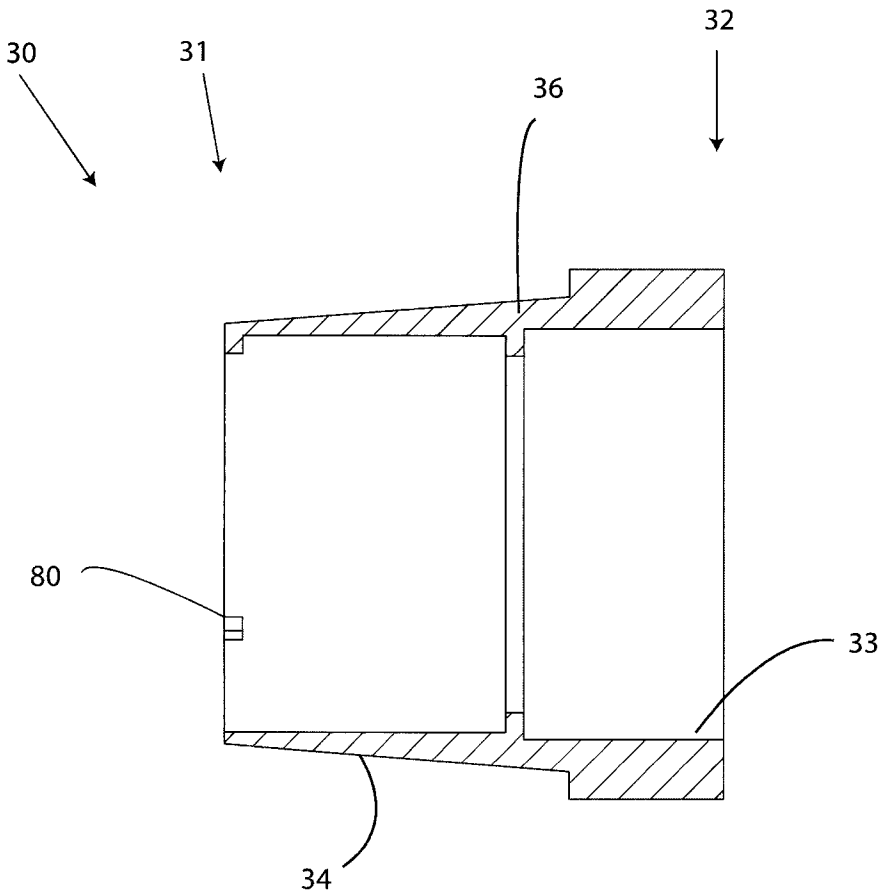
FIG. 5 depicts a cross-sectional view of an embodiment of a sleeve member.

With continued reference to FIGS. 1 and 3, and further reference to FIG. 5, embodiments of connector 100 may include a sleeve member 30. The sleeve member 30 may be an outer body, an outer sleeve, a rotatable sleeve member, and the like, for various embodiments of a push-on connector employing a plurality of engagement fingers 45 to compress/lock onto a port 20. The sleeve member 30 may include a first end 31, second end 32, an inner surface 33, and an outer surface 34. The sleeve member 30 may axially slidably engage the post 40, such that the sleeve member 30 may be axially slid from a first position to a second position, while contacting the outer surface 44 of the post 40. The inner surface 33 of the sleeve member 30 may be a smooth, non-threaded surface to allow a smooth gradient of contact with the outer (usually tapered) surface 44 of the post basket 45 as the sleeve member 30 is axially displaced. The sleeve member 30 may include a generally axially opening therethrough that allows the sleeve member 30 to be axially inserted over the post basket 45 and portions of the post 40 and connector body 50. Moreover, embodiments of the sleeve member 30 may include an annular internal lip 36 proximate the second end 32 of the sleeve member 30. The lip 36 may be configured to act as an internal stop feature. For instance, the internal annular lip 36 may prevent axial movement of the sleeve member 30 towards the first end 1 of the connector 100 when the lip 36 comes into physical contact with the underside of the flange 48 of the post 40, as shown in FIGS. 7A and 7B. The internal annular lip 36 may be located a distance from the first end 31 of the sleeve member 30 that allows the sleeve member 30 to advance a distance to sufficiently/adequately surround and compress the fingers 75 before physical engagement with the flange 48 of the post 40. However, the sleeve member 30 may be rotatably secured to the post 40 to allow for rotational movement about the post 40.

Embodiments of sleeve member 30 may also include one or more protrusions 80 proximate the first end 31 of the sleeve member 30. The protrusion(s) 80 may be one or more projections, bumps, protrusions, and the like, that project and/or extend a distance from the inner surface 33 of the sleeve member 30. The protrusions 80 may be structurally integral with the sleeve member 30, or may be structurally independent yet permanently connected to the inner surface 33 of the sleeve member 30. The protrusions 80 may be located along the inner surface 33 of the sleeve member 30 proximate or otherwise near the first end 31 of the sleeve member 30, and may be spaced apart according to the spatial location of the openings 76 between the engagement fingers 75. In other words, the location of each protrusion 80 along the inner surface of the sleeve member 30 may correspond to a location that would allow the protrusion 80 to pass through the openings 76 when the sleeve member 30 is axially slid back and forth from a first, open, unlocked position to a second, closed, locked position. The size and dimension of the protrusions 80 may depend on the width of each opening 76 and surface 77 of the engagement fingers 75. Embodiments of sleeve member 30 may include a single protrusion 80 proximate the first end 31 of the sleeve member 30, or may include a plurality of protrusions spaced apart from each other extending around or partially around the sleeve member 30 proximate the first end 31. Thus, the locations, configurations, orientations, and the number of protrusions 80 may vary.

Furthermore, the sleeve member 30, including the one or more protrusions 80, may be formed of non-conductive materials, such as plastic, and may function to physically secure and advance a connector 100 onto an interface port 20 while compressing/locking the engagement fingers 75 onto the port 20. Embodiments of sleeve member 30 may further include external surface features to facilitate gripping of the sleeve member 30, or may include an ergonomic shape to accommodate a user's thumb and fingers. In addition, the sleeve member 30 may be formed of polymers or other materials that would facilitate a rigidly formed body. Manufacture of the sleeve member 30 may include casting, extruding, cutting, turning, tapping, drilling, injection molding, blow molding, or other fabrication methods that may provide efficient production of the component.

Referring still to FIGS. 1 and 3, embodiments of a coaxial cable connector, such as connector 100, may include a connector body 50. The connector body 50 may include a first end 51, a second end 52, an inner surface 53, and an outer surface 54. Moreover, the connector body 50 may include a post mounting portion 57 proximate or otherwise near the first end 51 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the first end 51 of the connector body 50. Furthermore, the connector body 50 may include a semi-rigid, yet compliant outer surface 54, wherein the outer surface 54 may be configured to form an annular seal when the second end 52 is deformably compressed against a received coaxial cable 10 by operation of a fastener member 60. The connector body 50 may include an external annular detent located along the outer surface 54 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIGS. 1 and 3, embodiments of a coaxial cable connector 100 may include a fastener member 60. The fastener member 60 may have a first end 61, second end 62, inner surface 63, and outer surface 64. In addition, the fastener member 60 may include an internal annular protrusion located proximate the first end 61 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the second end 62 of the fastener member 60 and a second opening or inner bore having a larger, second inner diameter positioned proximate or otherwise near the first end 61 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature positioned proximate with or close to the second end 62 of the fastener member 60. The surface feature may facilitate gripping of the fastener member 60 during operation of the connector 100. Although the surface feature is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides proximate to the sleeve member 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Figure 6A:
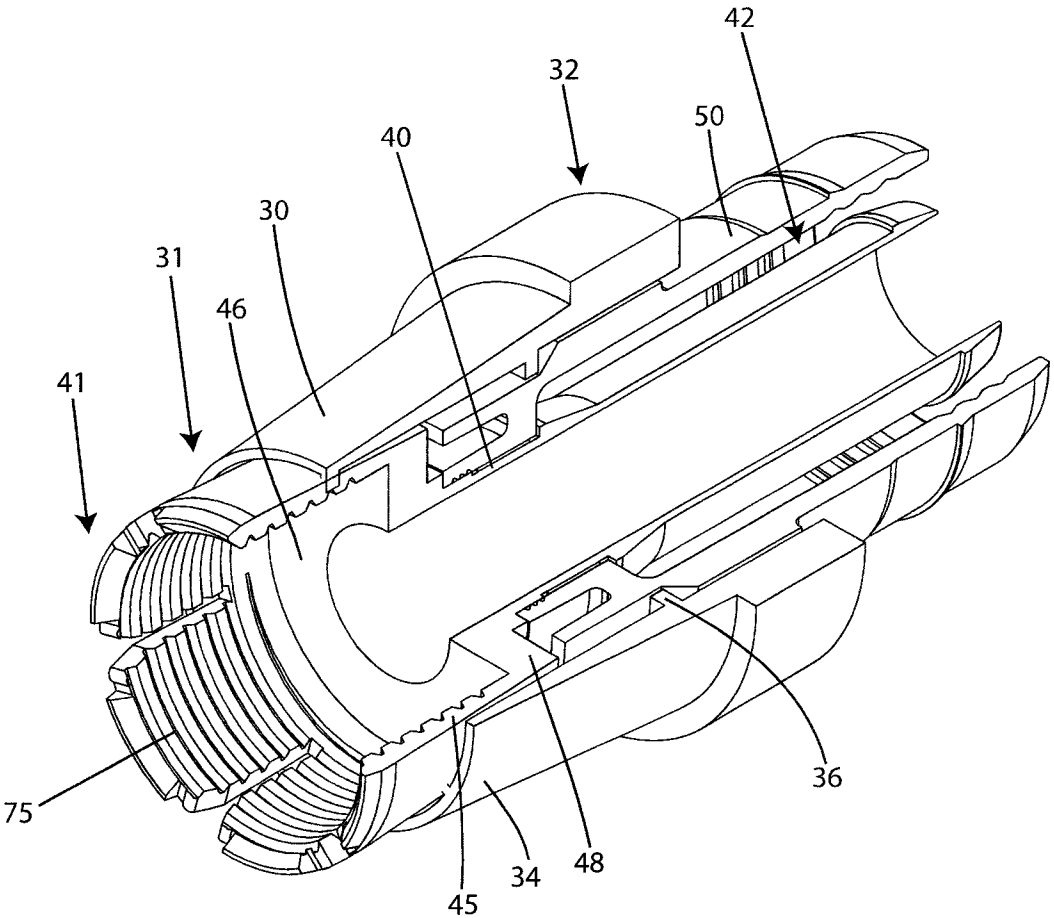
FIG. 6A depicts a perspective cut-away view of an embodiment of the connector in an unlocked, open position.
Figure 6B:
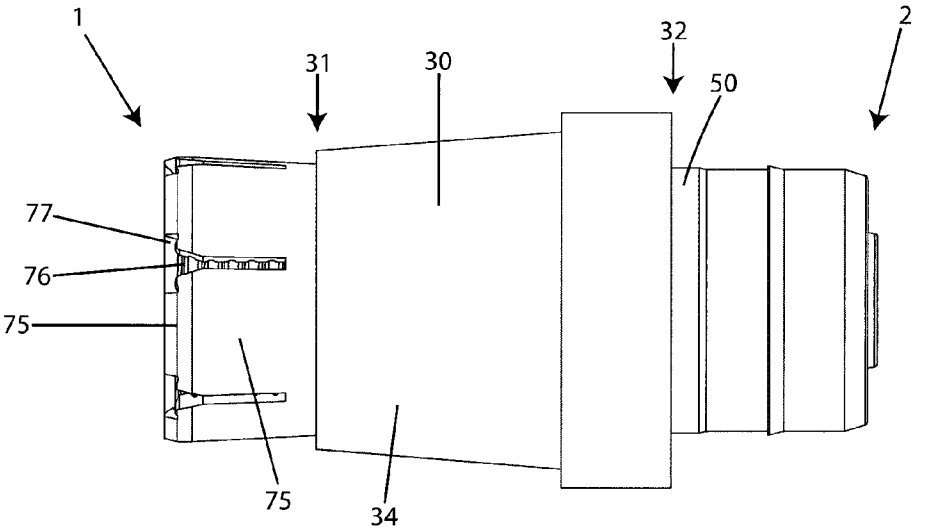
FIG. 6B depicts a side view of an embodiment of the connector in the unlocked, open position.
Figure 7C:
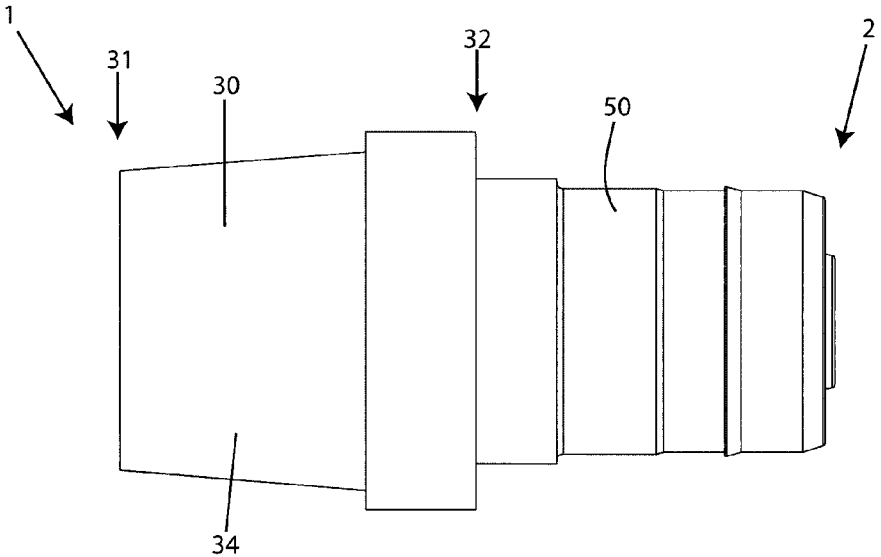
FIG. 7C depicts a cross-section view of an embodiment of the connector in the locked, closed position.
Figure 6C:
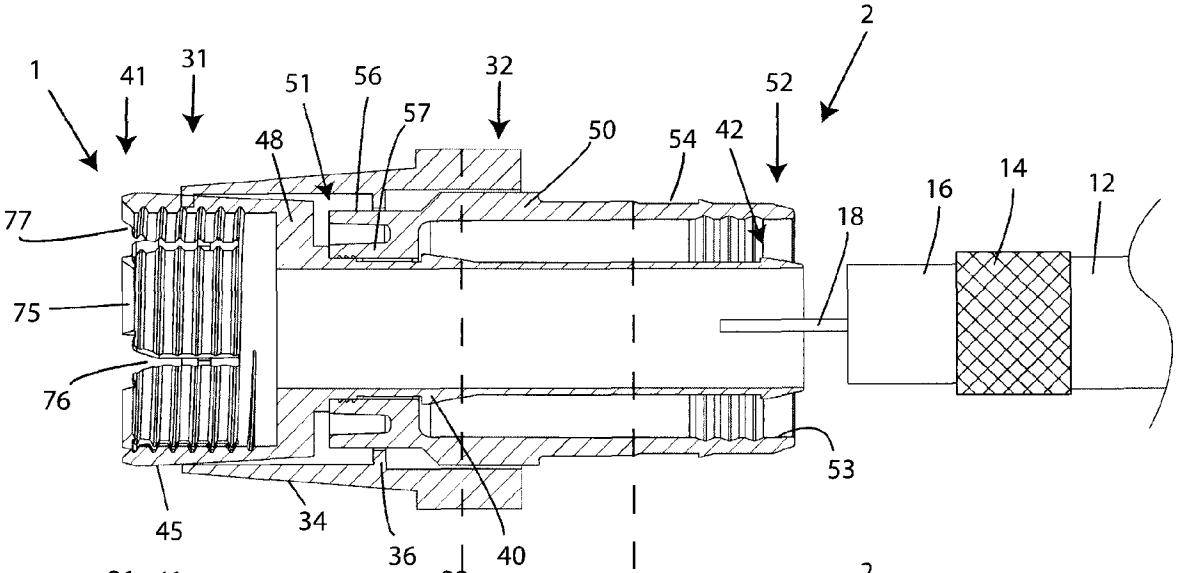
FIG. 6C depicts a cross-section view of an embodiment of the connector in the unlocked, open position.
Figure 7B:
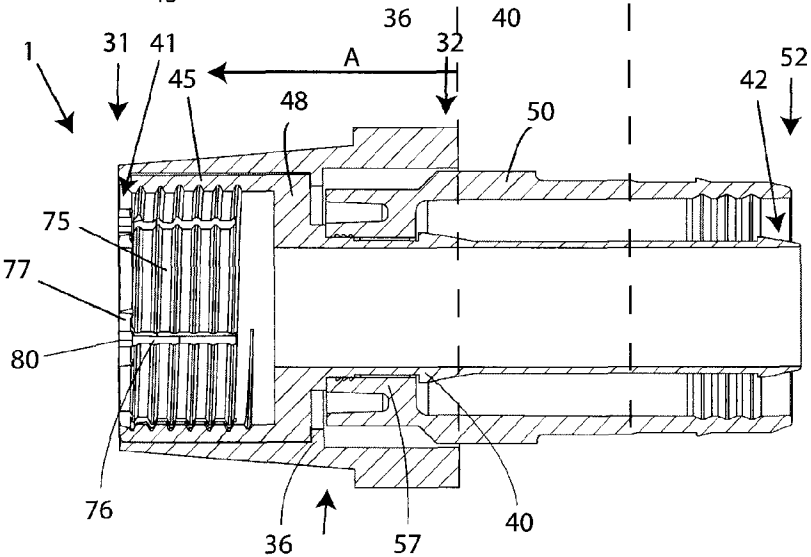
FIG. 7B depicts a side view of an embodiment of the connector in the locked, closed position.
Figure 7A:
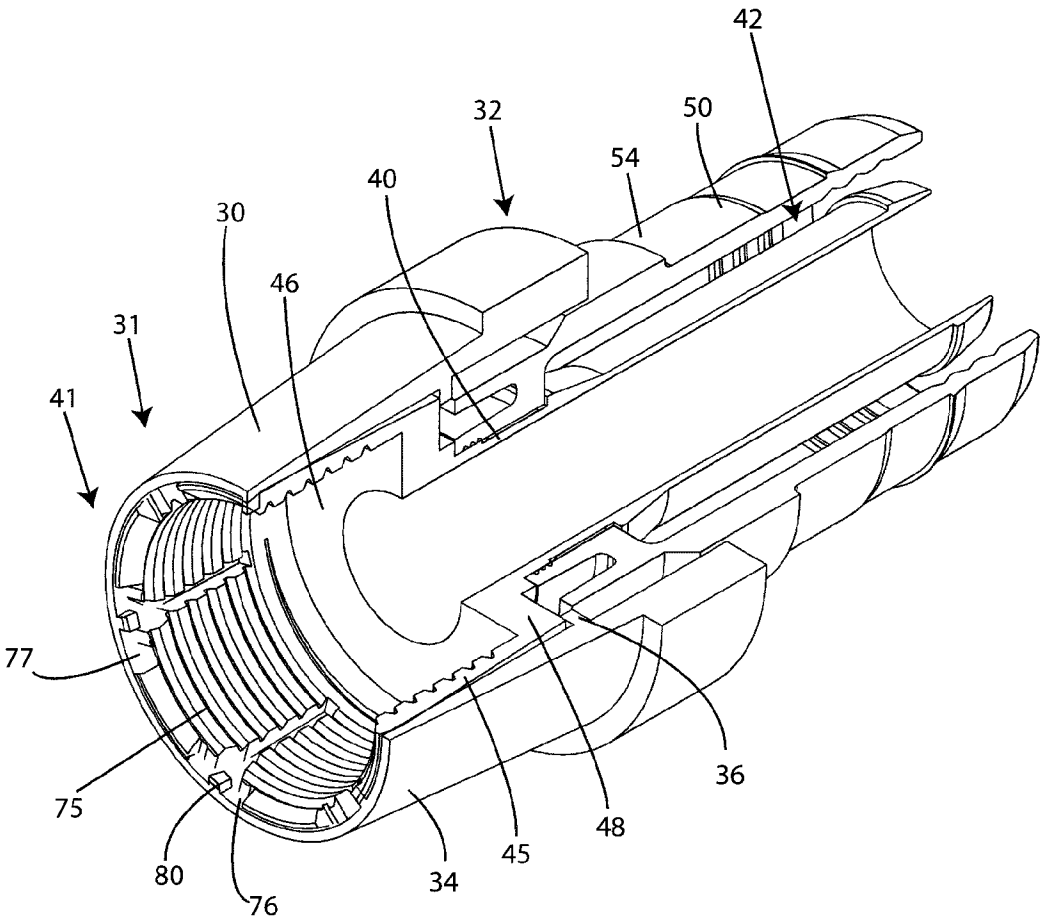
FIG. 7A depicts a perspective cut-away view of an embodiment of the connector in a locked, closed position.

Referring now to FIGS. 6A-7C, the manner in which the coaxial cable connector 100 is secured into a locked position will now be described. FIGS. 6A-6C depict an embodiment of the connector 100 in a first position. The first position may be an open or unlocked position. In the first, unlocked position, the engagement fingers 75 may be in a spread open configuration, adapted to receive the port 20 as the connector is axially advanced onto the port 20. For example, the post basket 45 may be uncompressed in the first position, the majority of the post basket 45 may be located outside of the sleeve member 30 such that the majority of the post basket 45 is visible to a user. FIGS. 7A-7C depict embodiments of connector 100 in a second, locked position. Once the connector 100 is axially advanced into the port 20, for example, until the mating edge 26 of the port 26 contacts the mating edge 46 of the port 20, a user may slide the sleeve member 30 forward (towards the first end 1 of the connector 100 to lock the engagement fingers 75 onto the port 20. Those having skill in the art should appreciate that the connector need not be advanced until the mating edge 26 of the port 20 contacts the mating edge 46 of the post 40, as the contact between the engagement finger 75 and the port 20 may extend electrical continuity through the connector 100. Sliding the sleeve member 30 forward results in a smooth gradient of contact between the inner surface 33 of the sleeve member 30 and the post basket 45 as the sleeve member 30 is slid forward. Because of the tapered outer surface (i.e. gradually increasing diameters) of the post basket 45, the sleeve member 30 acts to compress the post basket 45 in a radially inward direction as the sleeve member 30 is axially slid forward, in the A direction. In other words, as the sleeve member 30 is slid towards the first end 1 of the connector, the engagement fingers 75 may be compressed into firm engagement with the port 20, establishing radial contact between the port 20 and the engagement fingers 75. The sleeve member 30 may be slid forward until the internal lip 36 physically contacts the flange 48 of the post 40. Additionally, as the sleeve member 30 is slid forward, the protrusions 80 may pass through the openings 76 in the post basket 45, and reside proximate the first end 41 of the post 40, as shown in FIG. 7B. In this position, the connector 100 is in a locked position with respect to the sleeve member 30 being in a second position, wherein the first end 31 of the sleeve member 30 is substantially proximate to the first end 41 of the post 40/post basket 45.

Figure 8A:
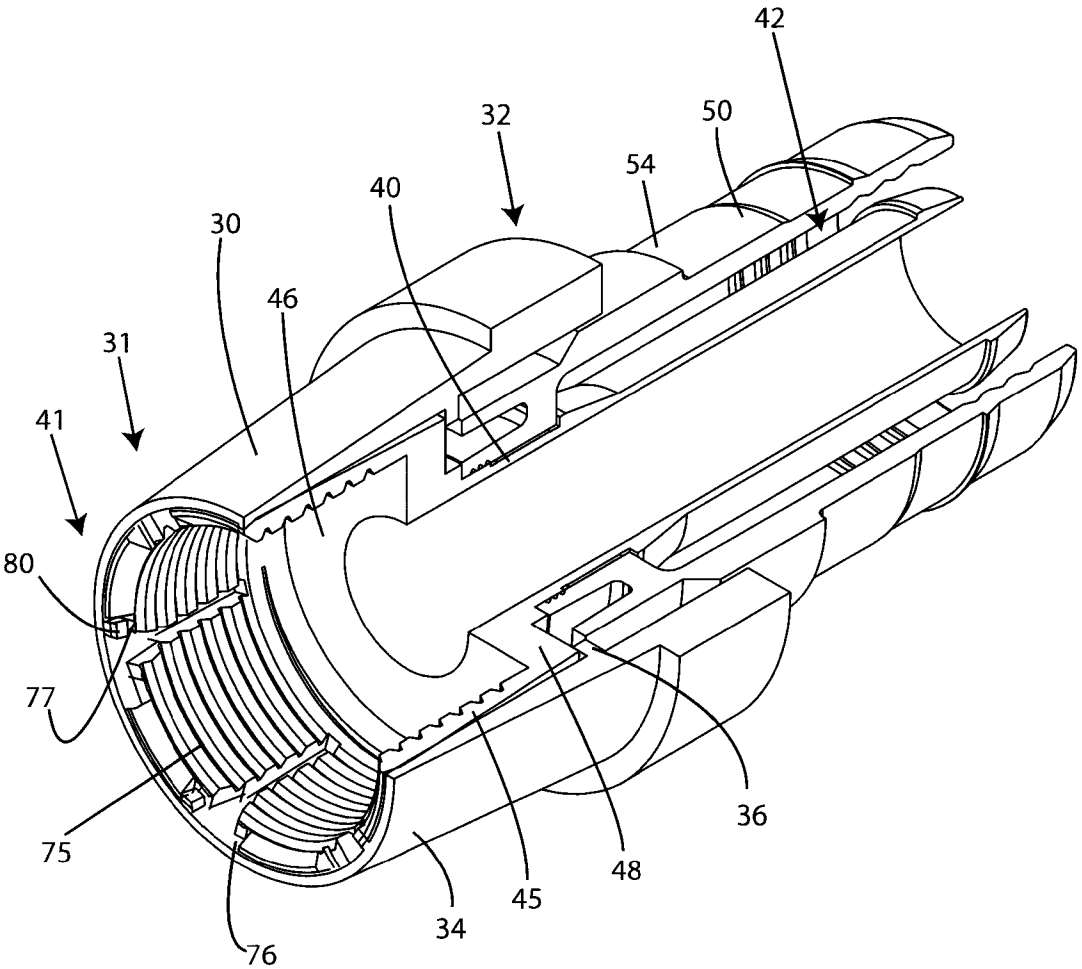
FIG. 8A depicts a cut-away perspective view of an embodiment of a connector in a fully secured position.
Figure 8B:
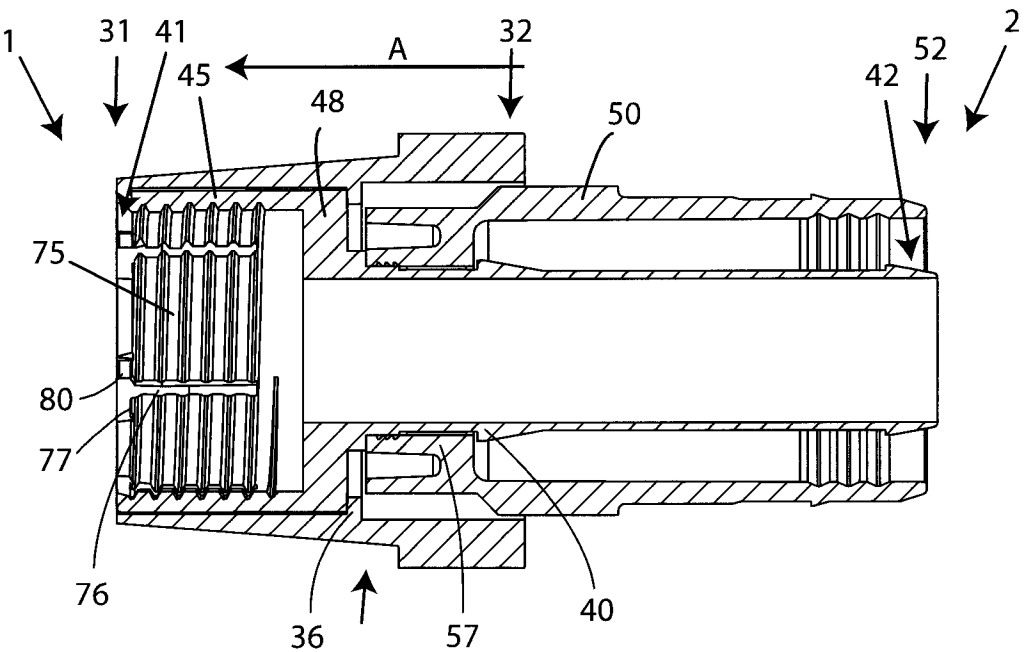
FIG. 8B depicts a cross-section view of an embodiment of a connector in the fully secured position.

However, in the locked position, the sleeve member 30 needs only to be axially displaced to release the engagement fingers 75 from compressed engagement with the port 20. Thus, if a user wishes to disconnect the connector 100 from the port 100, he or she need only to pull and/or slide the sleeve member 30 in an axial direction and slightly pull on the connector 100. In many instances, the sleeve member 30 can get unintentionally pulled, slid back or axially dislodged, or the frictional engagement of the components with respect to an axial direction may weaken, and the sleeve member 30 may recede toward the second end 2 of the connector. To avoid the unwanted disengagement, a user may simply, when the connector is in the locked position as shown in FIGS. 7A and 7B, rotate/twist the sleeve member 30 in a clockwise or counter-clockwise direction to position the one or more protrusions 80 proximate or into physical contact with the notched surface(s) 77 of the engagement fingers 75, as shown in FIGS. 8A and 8B (fully secured position). The notched surface 77 of the engagement finger 75 can provide a normal force against the protrusion 80 in an axial direction opposite of the direction needed to slide the sleeve member 30 back into a first, unlocked position. The engagement between the protrusion 80 and the notched surface 77 of the engagement finger 75 can prevent axial movement of the sleeve member 30, thereby ensuring the locked position of the connector 100 onto a port 20. To remove the connector from the port 20, the user may simply twist the sleeve member 30 in an opposite direction until the protrusions 80 are relatively lined up with the openings 76 of the post basket 45, and axially slide the sleeve member 30 back to the first position.

Referring to FIGS. 1-9, a method of securing a connector 100 onto a port 20 may include the steps of providing a post 40 configured to receive a center conductor 18 surrounded by a dielectric 16 of a coaxial cable 10, the post 40 including a plurality of engagement fingers 75, a connector body 50 attached to the post 40, and a sleeve member 30 slidably moveable along the post 40 from a first position to a second position, wherein the sleeve member 30 includes one or more protrusions 80 proximate the first end 31, and rotating the sleeve member 30, when the sleeve member 30 is in the second position, to position the protrusions 80 into contact with the plurality of engagement fingers 75 to secure the connector in a locked position.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A coaxial cable connector for mating with an interface port having external threads, comprising:

a post configured to receive a center conductor surrounded by a dielectric of a coaxial cable, and be insertable under a conductive shield of the coaxial cable, the post including a plurality of engagement fingers, wherein the plurality of engagement fingers directly contact the external threads of the interface port during mating between the interface port and the connector;

a connector body attached to the post; and a sleeve member attached to the post and having a first end and a second end, wherein the sleeve member includes one or more protrusions proximate the first end configured to contact the plurality of engagement fingers to secure the connector in a locked position.

2. The cable connector of claim 1, wherein the sleeve member is axially slidably attached to the post to facilitate axial movement from a first position to a second position.

3. The cable connector of claim 1, wherein rotation of the sleeve member positions the protrusions into contact with the plurality of engagement fingers.

4. The cable connector of claim 2, wherein the first position of the sleeve member corresponds to an unlocked position of the connector, and the second position of the sleeve member corresponds to the locked position of the connector.

5. The cable connector of claim 1, wherein the protrusions contact a notched surface of the engagement fingers.

6. The cable connector of claim 1, further comprising a fastener member radially disposed over the connector body to radially compress the connector body onto the coaxial cable.

7. The cable connector of claim 1, wherein the physical contact between the protrusions and the engagement fingers prevents axial movement of the sleeve member in an axial direction away from the port.

8. The cable connector of claim 1, wherein a plurality of openings space apart the plurality of engagement fingers to facilitate compression of the engagement fingers on the port.

9. A coaxial cable connector for connecting to an interface port comprising:

a post having a first end and a second end, the second end being insertable under a conductive shield of a coaxial cable, the post further including a post basket, wherein the post basket includes one or more engagement fingers, wherein the post basket receives the port during mating between the interface port and the connector;

a connector body attached to the post; and a sleeve member slidably engaged to the post and having a first end and a second end, the sleeve member having one or more protrusions located proximate the first end of the sleeve member, wherein the sleeve member is slidable from a first position to a second position;

wherein rotation of the sleeve member when the sleeve member is in the second position, positions the protrusions into contact with the plurality of engagement fingers to secure the connector in a locked position.

10. The coaxial cable connector of claim 9, wherein the first position of the sleeve member corresponds to an unlocked position of the connector, and the second position of the sleeve member corresponds to the locked position of the connector.

11. The coaxial cable connector of claim 9, wherein the protrusions contact a notched surface of the engagement fingers.

12. The coaxial cable connector of claim 9, wherein the post basket is resilient to facilitate radial compression of the engagement fingers onto the port.

13. The coaxial cable connector of claim 9, further comprising a fastener member radially disposed over the connector body to radially compress the connector body onto the coaxial cable.

14. The coaxial cable connector of claim 9, wherein the physical contact between the protrusions and the engagement fingers prevents axial movement of the sleeve member in an axial direction away from the port.

15. A method of securing a connector onto a port, comprising:

providing a post configured to receive a center conductor surrounded by a dielectric of a coaxial cable, and be insertable under a conductive shield of the coaxial cable, the post including a plurality of engagement fingers configured to receive the port during mating with the port, a connector body attached to the post, and a sleeve member slidably moveable along the post from a first position to a second position, wherein the sleeve member includes one or more protrusions proximate the first end; and rotating the sleeve member, when the sleeve member is in the second position, to position the protrusions into contact with the plurality of engagement fingers to secure the connector in a locked position.

16. The method of claim 15, wherein the first position of the sleeve member corresponds to an unlocked position of the connector, and the second position of the sleeve member corresponds to the locked position of the connector.

17. The method of claim 15, wherein the protrusions contact a notched surface of the engagement fingers.

18. The method of claim 15, wherein the contact between the protrusions and the engagement fingers prevents axial movement of the sleeve member in an axial direction away from the port.

19. The method of claim 15, wherein a plurality of openings space apart the plurality of engagement fingers to facilitate compression of the engagement fingers on the port.

20. A jumper comprising:

a first connector, wherein the first connector includes a post configured to receive a center conductor surrounded by a dielectric of a coaxial cable, and be insertable under a conductive shield of the coaxial cable, the post including a plurality of engagement fingers configured to receive a port during mating with the port, a connector body attached to the post, and a sleeve member slidably moveable along the post from a first position to a second position, wherein the sleeve member includes one or more protrusions proximate the first end; and a second connector;

wherein the first connector is operably affixed to a first end of the coaxial cable, and the second connector is operably affixed to a second end of the coaxial cable.

21. The jumper of claim 20, wherein the second connector includes the same components as the first connector.

* * * * *